United States Patent [19]

Bierbaum et al.

[11] Patent Number: 4,748,922

[45] Date of Patent: Jun. 7, 1988

[54] DEVICE FOR THE MANUFACTURE OF PARTIALLY FABRICATED FITTED ELASTIC BEDSHEETS OR SIMILAR SEAT COVERS

[75] Inventors: Joe Bierbaum, Borken; Siegfried Henze, Hohenroth; Karl Müssig, Königshofen; Hans Ziegler, Grossbardorf, all of Fed. Rep. of Germany

[73] Assignee: Texas Arbter Mashinenbau GmbH, Saal/Salle, Fed. Rep. of Germany

[21] Appl. No.: 936,082

[22] Filed: Nov. 28, 1986

[30] Foreign Application Priority Data

Nov. 30, 1985 [DE] Fed. Rep. of Germany ..... 3542394

[51] Int. Cl.[4] ..... D05B 21/00; D05B 3/22; D05B 35/00

[52] U.S. Cl. ..... 112/121.12; 112/121.26; 112/121.27; 112/131; 112/113; 112/272; 112/218

[58] Field of Search ..... 112/121.12, 121.15, 112/121.11, 131, 121.26, 121.27, 305, 104, 113, 272, 218

[56] References Cited

U.S. PATENT DOCUMENTS

| | | | |
|---|---|---|---|
| 2,940,404 | 6/1960 | Damon | 112/10 |
| 3,126,848 | 3/1964 | Gastonquay | 112/121.12 X |
| 3,208,419 | 9/1965 | Frydryk | 112/262.2 |
| 4,388,879 | 6/1983 | Everall, Jr. et al. | 112/10 |
| 4,621,585 | 11/1986 | Ball et al. | 112/121.11 X |

*Primary Examiner*—H. Hampton Hunter
*Attorney, Agent, or Firm*—Frank P. Presta

[57] ABSTRACT

In order to mechanically prefabricate fitted elastic bedsheets of such dimensions that the manual work steps still required for completion of the fitted elastic bedsheets can be carried out efficiently in a short time, a device is provided which includes a first conveyor device for a strip of cloth, from which the individual fitted elastic bedsheets are cut. The first conveyor device intermittently draws lengths of the strip corresponding to the cut lengths of the fitted elastic bedsheets from a supply. A cutting device is provided at the end of the first conveyor device. At a right angle to first conveyor device is arranged a second device for the pieces of cloth which are cut by cutting device from strip of cloth. Stretched elastic bands are guided by feed devices along both lengthwise edges of the strip of cloth and along both cut edges of the pieces of cloth parallel to these edges in their stretched-out state against the strip of cloth or pieces of cloth, and finally are sewn tightly by sewing machines onto the strip of cloth or pieces of cloth. Sewing machines are positioned directly after the feed devices for the elastic strips. On each side of the second conveyor device are positioned additional cutting devices, which cut through the threads which still connect the individual pieces of cloth behind the sewing machines.

10 Claims, 6 Drawing Sheets

DEVICE FOR THE MANUFACTURE OF PARTIALLY FABRICATED FITTED ELASTIC BEDSHEETS OR SIMILAR SEAT COVERS

BACKGROUND OF THE INVENTION

The present invention relates to a device for the manufacture of partially fabricated fitted elastic bedsheets or similar seat covers, in which rectangular pieces of cloth are cut from a strip of cloth by means of a cutting device.

In a device of this type, the strip of cloth is first stored in a stack or the like by means of a lengthwise stacking mechanism, to be cut through the middle by means of a cutting blade, in order to obtain rectangular pieces of cloth. Furthermore, in this device, the cut edges of both stack halves have the corners cut off by rectangular or almost rectangular cutaway portions. Thus the operation using this known device has been limited, and all further work steps for the production of the fitted elastic bedsheets have had to be carried out manually. The sewing of the elastic bands or the like on or in the edges of the cloth in stretched-out state especially required not only skill but also considerable time. Also, with these methods, numerous transfer steps are required for the article being sewn as is a relatively large storage space for intermediate storage of the sewn article.

SUMMARY OF THE INVENTION

The object of the present invention is to provide a device by means of which the partially fabricated fitted elastic bedsheets or similar seat covers can be produced, with stretched elastic bands or the like already sewn on or in them. The device also contributes to saving space for conveyance paths and spare storage space for the sewn articles.

The object is attained by a device which is characterized according to the invention by the following:

a. a first conveyor device for the strip of cloth, which draws strip lengths intermittently from a supply of cut lengths corresponding to the partially fabricated fitted elastic bedsheets;
b. arrangement of the cutting device at the end of the first conveyor device;
c. a second conveyor device for the pieces of cloth which are cut from the strip of cloth by the cutting device, arranged at a right angle to the conveyor device for the strip of cloth;
d. feed devices for stretched elastic bands or the like along both lengthwise edges of the strip of cloth and along both cut edges of the pieces of cloth, which include guide means for the stretched elastic bands to guide them in stretched-out state parallel to both lengthwise edges of the strip of cloth or parallel to the cut edges of the pieces of cloth facing them;
e. the feed devices for the stretched elastic bands in the direction of conveyance of the strip of cloth or pieces of cloth arranged directly subsequent to the sewing machines for the rapid stitching of the parallel edge to the stretched elastic bands to the strip of cloth or pieces of cloth; and
f. cutting devices at each side of the second conveyor device for cutting through the materials which are connecting the pieces of cloth behind the sewing machines.

Using the device according to the invention, partially fabricated fitted elastic bedsheets or similar seat covers can be manufactured completely automatically and commercially, at the edges of which the stretched elastic bands are sewn on in such a manner that when they are slackened they cause formation of folds or wrinkles of the edges of the cloth. In order to entirely complete the fitted elastic bedsheets, the pieces of cloth being discharged from the device need only be folded diagonally at each corner, sewn together and then the folded sections cut off, which can be done in less work time, since it involves relatively short seams and cut lengths to be worked on flat pieces. The device is furthermore suitable as desired to work a supply of cloth strip in the form of a stack or a roll.

The conveyor devices can be started and stopped by strip length measuring devices and/or sensors, which for instance in the case of the second conveyor device can sense the edges of the cloth (cut edges). The operation of the second conveyor device is furthermore time-controlled relative to the operation of the first conveyor device. The feed devices for the stretched elastic bands and the sewing machines could be activated only for instance when the strip of cloth or the pieces of cloth cut from the strip of cloth are moved, and in this case the stretched elastic bands could pass along the entire lengthwise and transverse edges of the pieces of cloth. However, in order to spare the elastic band material, the feed devices and the sewing machines could also be operated intermittently, only when the strip of cloth or the pieces of cloth pass by. Their operation can then be controlled by sensors which sense markings which are presented at uniform spacing on the strip of cloth. Therefore, relatively short stretched elastic bands can be sewn securely to the edges of the pieces of cloth, actually so that they are at a certain spacing from the corners of each piece of cloth, since the segments of cloth are simply then cut off with the corners upon completion of the fitted elastic bedsheets.

The cutting devices in the vicinity of the second conveyor device could for instance be controlled by scanners which scan the lengthwise edges of the pieces of cloth, in order to cut through the sewn threads in the case of stretched elastic bands passing through them and also to cut through them when they are between the separate pieces of cloth, so that in the discharge area of the second conveyor device the pieces of cloth are separated off and can be fed in one after the other to another processing station, where the fitted elastic bedsheets are being finished.

Other configurations are within the scope of the present invention. One such configuration is characterized in that each feed device for a stretched elastic band has at least one pressure roller holding the stretched elastic band against the strip of cloth or the piece of cloth, in order to feed the elastic band through friction contact dependent upon the movement of the strip of cloth or pieces of cloth. This type of feed of the stretched elastic bands against the strip of cloth or pieces of cloth is quite simple and reliable.

Still another configuration of the invention is characterized in that each feed device for stretched elastic bands has a brake element which can press the elastic strip against a stationary foundation. Thus, the stretched elastic band can be brought into either stretched-out or slackened state as required for the sewing, and the degree of pre-bias of the elastic band can be controlled by the pressure with which the brake element presses the elastic band against the stationary foundation.

Another configuration of the invention is characterized in that the pressure rollers can be swivelled and each elastic band feed device includes a cutting blade for the elastic bands, which is series-mounted in the direction of movement of the strip of cloth or pieces of cloth following the pressure rollers, and after each cutting blade is inserted at least one more pressure roller for the elastic band. Thus, the elastic bands could advantageously and with simple means be sectioned or be guided and applied in relatively short lengths against the strip of cloth or pieces of cloth. The pressure roller following each cutting blade prevents a premature cutting or slackening of the elastic band following the separation cut.

When, according to still another configuration of the invention, a folding element for the lengthwise edges of the strip of cloth or the cut edges of the pieces of cloth is inserted after the feed devices for the stretched elastic bands, which can fold the edges around the stretched elastic bands, the bands can advantageously be covered on the outside and sewn into these folded-over cloth edges.

Another development of the invention can also advantageously be used in the direction of movement of the strip of cloth before the feed devices for stretched elastic bands, and that is the arrangement of marking devices which can be raised and lowered adjacent to both lengthwise edges of the strip of cloth, in order to apply markings to the strip of cloth, and sensors too can be provided for scanning these markings, which control the stretched elastic band feed devices, the sewing machines and also the drive of the cutting device for the strip of cloth. These marking devices are placed in operation when the first conveyor device has lifted off cut lengths of the fitted elastic bedsheets from the strip of cloth and has been disconnected, so that the strip of cloth is then in rest position, in which the drive of the cutting device is also connected, in order to cut a piece of cloth from the strip of cloth.

Over the strip of cloth, it is advantageous to provide a control in the form of a length measuring apparatus provided with a measuring wheel, driven by the strip of cloth, which controls at least the motor drive of the first conveyor device. Such a length measuring device works especially reliably.

According to still another feature of the invention, the first conveyor device for the strip of cloth has a clamp which can be moved back and forth lengthwise, inserted following the cutting device in the direction of movement of the strip of cloth, for picking up and cut edge of the strip of cloth, and the path of the clamp intersects the beginning area of the second conveyor device and the second conveyor device has bottom and top conveyor belts and a part of the top conveyor belt can be raised and lowered. If these top conveyor belts of the second conveyor device are raised, the clamp on the first conveyor device can draw the strip of cloth down for the cut length of a fitted elastic bedsheet over the bottom conveyor belt of the second conveyor device and top conveyor belt could again be lowered and brought into engagement with the strip of cloth.

It is advantageous that the top conveyor belt be carried to the beginning of the second conveyor device by a frame or a hoist device which can be raised and lowered.

It is also advantageous to power the second conveyor device intermittently, so that it is in rest position when the first conveyor device is activated. The clamp of the first conveyor can thus draw the strip of cloth over the beginning area of the second conveyor, while its conveyor belts remain stationary. When the clamp has reached its starting position, the top conveyor belts are activated together with the bottom conveyor belts, in order to carry the cut piece of cloth further in lengthwise direction to the second conveyor device, after the clamp has freed the cut off piece of cloth for this purpose

BRIEF DESCRIPTION OF THE DRAWINGS

The invention will be explained hereinafter relative to the drawings of one exemplary embodiment. They show.

DESCRIPTION OF THE PREFERRED EMBODIMENTS

Figure 5:
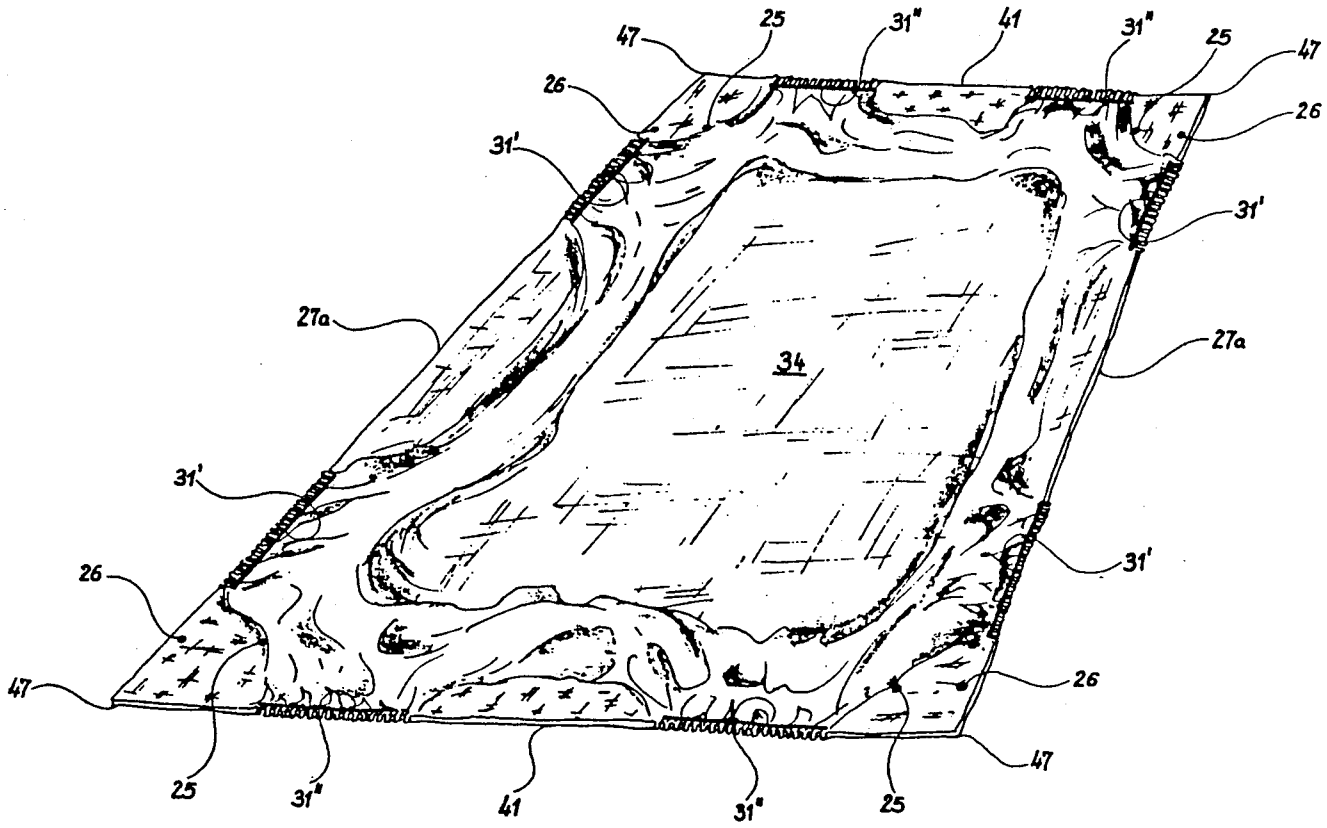
FIG. 5 is a perspective view of a fitted elastic bedsheet, partially fabricated, manufactured with the device of FIGS. 1 and 2, to which are fastened all of the stretched elastic bands.

As starting material for the prefabricated or partially fabricated fitted elastic bedsheets, of which one is shown at 34 in FIG. 5, a strip of cloth 10, which is drawn from a supply source 12 over a guide pulley 11 through a first conveyor device 60 (FIGS. 2 and 2), intermittently, for the lengths of a fitted elastic bedsheet. First conveyor device 60 has a drive roller 13, driven by an electric motor 14, another drive roller 16, driven by an electric motor 17, and a clamp 32 which can be moved back and forth by an electric motor 39 lengthwise to the strip of cloth 10, and the clamp drive mechanism is to be described in more detail hereinafter. Drive rollers 13 and 16 are operated synchronously and are controlled by the pulling of clamp 32 (of FIG. 2, right). Two compensating rollers 15 stretch strip of cloth 10 lengthwise. Compensating rollers 15 are mounted parallel at some spacing with their ends each on a lever 61, and can be moved up and down, and the levers in turn are articulated on the machine frame 46. Strip of cloth 10 runs from one drive roller 13 downward around a compensating roller 15, then up again and around another guide pulley 62 and down again and around the second compensating roller 15 and up over the other drive roller 16. Mounting plates 63 and 64 for strip of cloth 10 are also fastened to machine frame 46. Machine frame 46 also supports the aforementioned guide pulleys 11 and 62, drive rollers 13 and 16, and also their drive motors 14, 17. As a modification of the exemplary embodiment, cloth strip 10 can also be supplied from a roller, of which the axle rests on a bearing.

In the direction of the pulling of cloth strip 10 (shown by arrows in FIGS. 1 and 3), a cutting station or cutting device 18 is provided at some distance from drive roller 16. Cutting device 18 has a cutting blade 19 which can be raised and lowered by an electric motor 65 which drives in two directions of rotation, and has a stationary counterblade 20. This blade is mounted by means of two supports 66 on the machine frame 46, while cutting blade 19 is connected nonrotatably at one end with a beam 67, powered by an electric motor 65 and supported by a bearing block 68, which in turn is mounted on machine frame 46.

A retaining strip 21 is series-connected in front of both blades 19, 20, and can be worked by an operating cylinder 69, controlled either pneumatically or hydraulically, which can be moved up and down, and the retaining strip cooperates with the mounting plate 64 beneath strip 10, in order to clamp cloth strip 10, before the operation of cutting blade 19. Also, after cutting, cloth strip 10 is clamped tightly by retaining strip 21 for a short time longer, for reasons which are still to be described. Operating cylinder 69 is controlled by an electromagnetic valve 70, which receives its control pulses from an electric circuit 71 which is shown only diagrammatically in FIG. 1. Retaining strip 21 has rigid arms at its ends, which are articulated on supports 73, which in turn are fastened to machine frame 46. Operating cylinder 69 is arranged between machine frame 46 and an arm 72.

A length measuring apparatus 74 is provided adjacent to guide pulley 11 over cloth strip 10, and is supported by a bracket 75 which is fastened to machine frame 46. Length measuring apparatus 74 has a measuring wheel 22, driven by the drawing of cloth strip 10 from supply 12, and is connected for drive purposes with a pulse transmitter 23. Pulse transmitter 23 controls the electric motors 14, 17 and 39 over an electric control circuit 76, as is shown only diagrammatically in FIG. 1, so that each strip length in turn, which corresponds to the length of a fitted elastic bedsheet, is drawn from supply 12. When this happens and drive rollers 13, 16 are halted, clamp 32 has reached its starting position shown in FIG. 2, and strip of cloth 10 is stationary, two marking devices 24 which can be moved up and down and which rest next to each lengthwise edge 27 of cloth strip 10 are set in operation, making for example four marking points 25, 26 on the cloth. Marking devices 24 are mounted on machine frame 46 to slide on vertical columns 77, and the up and down movement of marking devices 24 occurs through an operating cylinder 78, which is arranged between machine frame 46 and the bearing member of marking device 24. Operating cylinders 78 are controlled by magnet valves 79, which in turn are connected with electric control circuit 76. For simplification of the description, it is assumed that all of the operating cylinders of the device are fed compressed air from a compressor 80 powered by an electric motor. Marking points 25, 26 could be of contrasting colors, including fluorescent colors for an optical scanning, or colors containing metals, for an inductive or capacitive scanning or the like, dependent upon the scanning members or sensors used in the device.

As to be described hereinafter, marking points 25, 26 are required for the final manual steps for completion of the article. Then marking points 26 are scanned by sensors 81, supported on brackets 82 mounted on machine frame 46. Sensors 81 are electrically connected with an electric control circuit 71 and through this they control a feed device 28 for a stretched elastic band 31 and also the drive motor 29 for a sewing machine 30 along each lengthwise edge 27 of strip of cloth 10. When strip of cloth 10 is drawn in the direction of the arrow for a cutting length for a fitted elastic bedsheet, by drive rollers 13, 16 and clamp 32, a first marking point 26 passes over a first sensor 81 and control circuit 71 connects feed device 28 for stretched elastic bands 31, which are guided in stretched-out state parallel to lengthwise edges 27 against strip of cloth 10, so that they are sewn in when sewing machines 30 are reached, inserted into cloth strip 10 parallel to the edge. When this marking point 26 runs through the second sensor 81 at some distance from the first sensor 81 in the direction of pulling of the cloth, further feed of elastic bands 31 is interrupted, the sewn-in elastic band segments are cut off and the drive of sewing machines 30 is disconnected. Thus, only stretched elastic bands of certain length, as indicated at 31' in FIG. 5, are sewn onto cloth strip 10, and on defined segments of cloth strip 10 actually controlled precisely by marking points 26.

Figure 1:
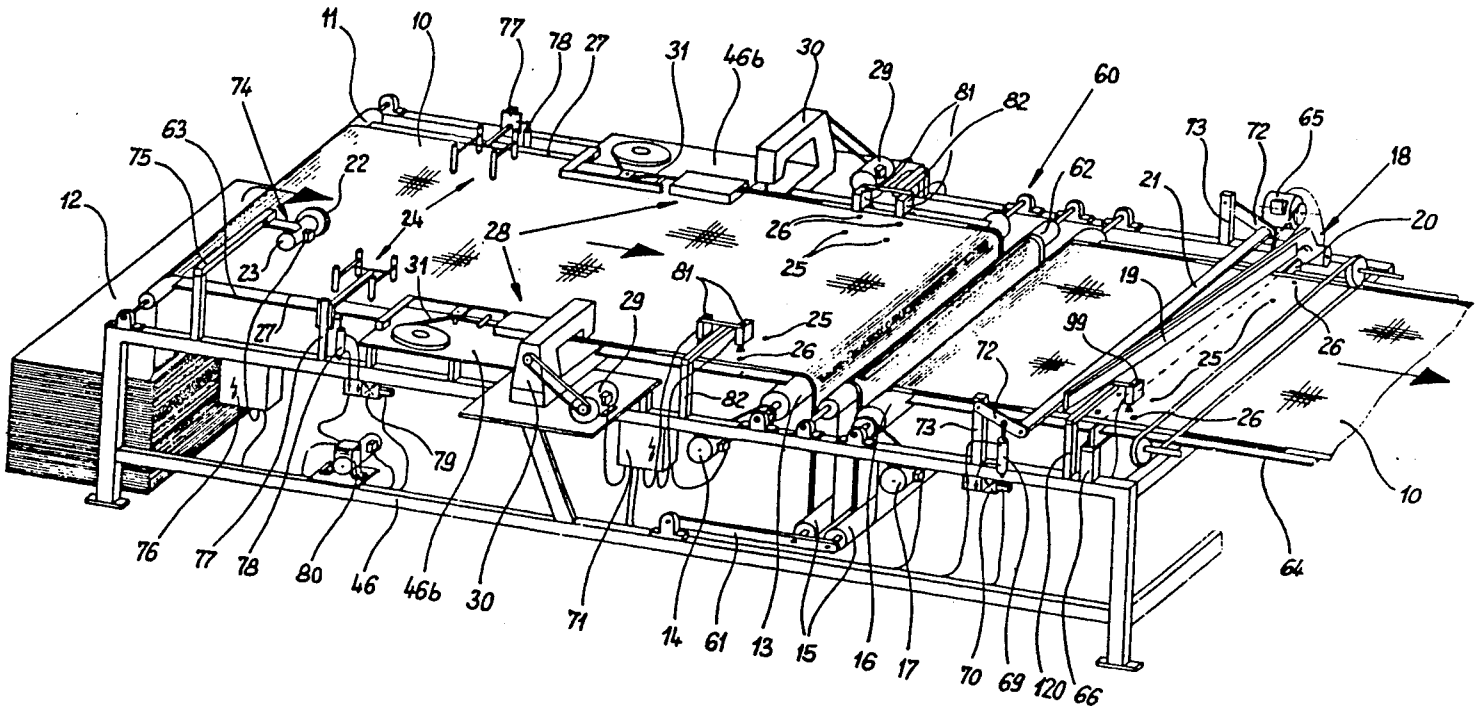
FIGS. 1 and 2 are perspective views of portions of the device according to the present invention for the manufacture of partially fabricated fitted elastic bedsheets.

Feed devices 28 for elastic bands 31, facing each lengthwise edge 27 of cloth strip 10, are shown only diagrammatically in FIG. 1, and it is to be noted that in this configuration and in their effect they are identical. Such a feed device 28 is represented in greater detail in FIG. 4.

Each feed device 28 for an elastic band 31 in stretched-out state has guide pulleys 83, 84 for the bands, in order to bring bands 31 out of vertical feed position into a horizontal working position. Guide pulleys 83 and 84 are positioned on machine frame part 46*a* and draw elastic band 31 from a roll 85, which is mounted rotatably on frame plate 46*b*. A brake element 87 which can be raised and lowered by an operating cylinder 86 is arranged at some spacing from guide pulley 84 in the direction of movement of strip of cloth 10, by which the stretched elastic band 31 can be pressed against a stationary base 88, which is fastened directly to operating cylinder 86 on frame part 46*a*, and also at some spacing over strip of cloth 10. A pressure roller 89 is provided at some spacing from brake element 87, in the direction of movement of cloth strip 10, which can press the elastic band 31 against cloth strip 10, which runs over a counterroller 90. Pressure roller 89 is mounted on a lever 91, which in turn is articulated on frame part 46 and can be pivoted up and down by an operating cylinder 92. Operating cylinder 92 is articulated with one end likewise on frame part 46*a*.

Figure 4:
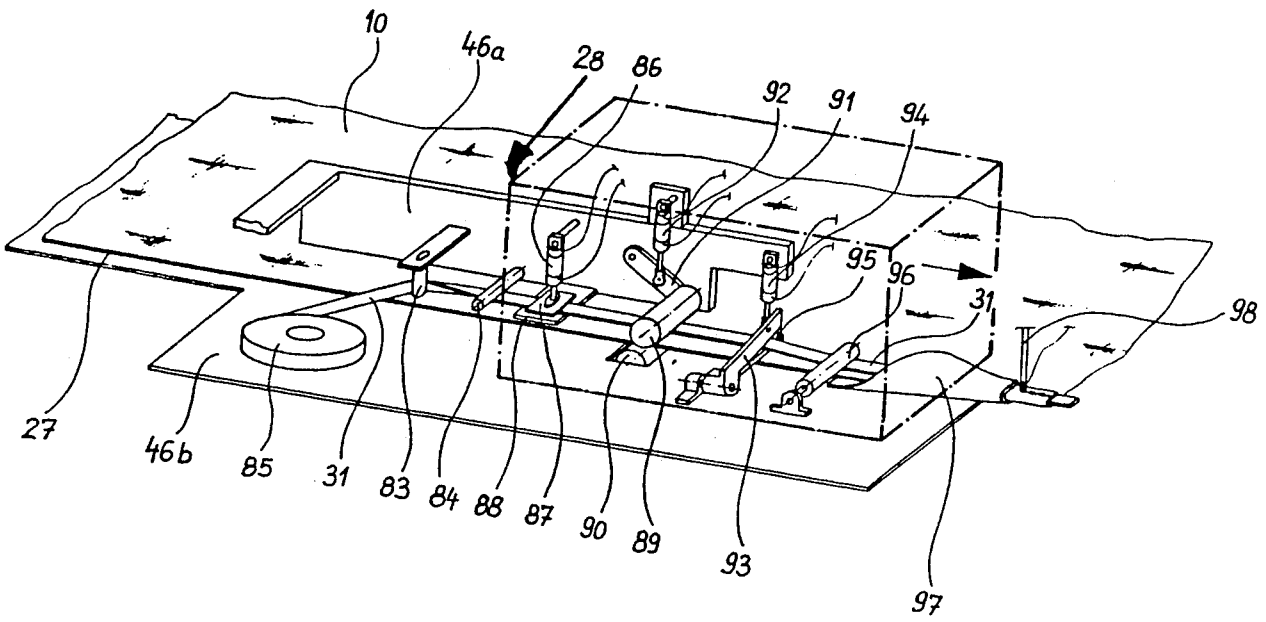
FIG. 4 is an enlarged perspective view of a portion of the device of FIGS. 1 and 2, showing a preferred feed device for a stretched elastic band.

Once more in the direction of the pulling of cloth strip 10, at some spacing from pressure roller 89, is attached a cutting blade 93 which is rotatable on frame plate 46*b*, which can be swiveled up and down by an operating cylinder 94, which is articulated with one end on frame part 46*a*. Cutting blade 93 works together with a counterblade 95 mounted rigidly on frame plate 466. Cutting blade 93 is series-connected in the exemplary embodiment with another pressure roller 96, which is rotatably mounted on frame plate 46*b* and which presses stretched elastic band 31 against cloth strip 10, before strip 31 is joined with the edge segment of cloth strip 10 to be introduced together into a folding element 97, which is mounted on frame plate 46*b*. With cloth strip 10 moving in the direction of the arrow, this folding element 97 causes a shift of lengthwise edge 27, so that the stretched elastic band 31 runs into the folded-over lengthwise edge of cloth strip 10. After release by folding element 97, elastic strip 31 is sewn by sewing machine 30 into the folded-around lengthwise edge of cloth strip 10. Only the sewing needle 98 of sewing machine 30 is shown in FIG. 4.

When a first marking point 26 passes first sensor 81, operating cylinders 86 and 92 are activated, and pressure roller 89 presses stretched elastic band 31 against cloth strip 10. Because of the friction contact which is thus produced, elastic band 31 is carried along by strip of cloth 10. Simultaneously brake element 86 presses elastic band 31 against stationary base 88, so that elastic band 31 is stretched out or slackened behind brake element 86. It reaches sewing needle 98 in stretched state. Thus the not stretched-out beginning and end segments of sewn-in elastic band 31 could be disregarded. Then when the aforementioned marking point 26 runs through second sensor 81, at some distance from first sensor 81 in the direction of movement, operating cylinder 94 is activated, which lowers cutting blade 93, whereupon sewn-in elastic band 31 is cut off from the rest. At the same time operating cylinders 86 and 92 are disconnected. Further band feed is now interrupted. As explained above, stretched elastic bands of predetermined lengths could be sewn into segments of cloth strip 10 which are precisely defined by marking points 26, while in stretched-out state. Thus, operating cylinder 94 for cutting blade 93 is controlled by marking points 26, so that the sewn-in elastic band segments 31' (FIG. 5) are at some distance from each corner 47 of piece of cloth 34.

Marking points 26 adjacent to at least one lengthwise edge 27 of cloth strip 10 are scanned further by a sensor 99, mounted on a bracket 120, which is mounted securely on machine frame 46. Through electric circuit 71, sensor 99 controls drive motor 65 of cutting blade 19 of cutting device 18 which can be moved up and down. As soon as the relevant moving marking point 26 runs through sensor 99, motor 65 is turned on, in order to lower cutting blade 19, so that the cut then runs in the middle between marking points 25, 25 or 26, 26 at some spacing from cloth strip 10 in lengthwise direction. Thus cloth strip 10 stands still, and conveyor device 60 is disconnected. For execution of the cut, cloth strip 10 is clamped tightly by retaining strip 21, and operating cylinder 69 has likewise been activated by sensor 99 through control circuit 71. When strip of cloth 10 is clamped tightly by retaining strip 91 and the cut has been executed by means of blade 19, the separated piece of cloth 34, which meanwhile has been released from clamp 32, can be carried further by second conveyor device 100 (FIG. 2) transverse to the length of cloth strip 10 in the direction of the arrow of FIG. 2, to the left.

Clamp 32 is fastened to an arm 102, which is mounted tightly on a carriage 103, which slides lengthwise on a slide 101 fastened to frame 46. Carriage 103 is tightly connected with an endless belt 104, which is driven by electric motor 39 working in two directions of rotation, so that clamp 32 can be moved back and forth in lengthwise direction on strip of cloth 10, including from its starting position shown in FIG. 2 to the cutting device 18 and back. Motor 39, as explained, is controlled from length measuring device 74. Clamp 32 in a known manner encompasses a stationary strip 53 and a pivotable gripping device 54, which are moved up and down, likewise in a known manner, in order to catch the cut edge 41 of cloth strip 10 and then in order to draw the cut lengths of a fitted elastic bedsheet as in FIG. 2 to the right over the beginning area of second conveyor device 100. For this to be possible, a part of second conveyor device 100 must be raised, which is still to be explained.

Second conveyor device 100 is arranged at a right angle to first conveyor device 60 for cloth strip 10 and it encompasses the bottom endless conveyor belt 35 and also top endless conveyor belt s 36 and 37. Bottom conveyor belt 35 and top conveyor belt 37 run synchronously, but in opposite directions, by drive belts 105 and 106 powered by an electric motor 107 (FIG. 3), which is connected intermittently either by lengthwise measuring apparatus 74 with corresponding time delay in relation to the activation of first conveyor device 60 or by not shown sensors, which scan the lengthwise edges **27*a* of pieces of cloth 34. In other words, second conveyor device 100 is activated when the first conveyor device 60** is not in operation, and vice versa.

Figure 2:
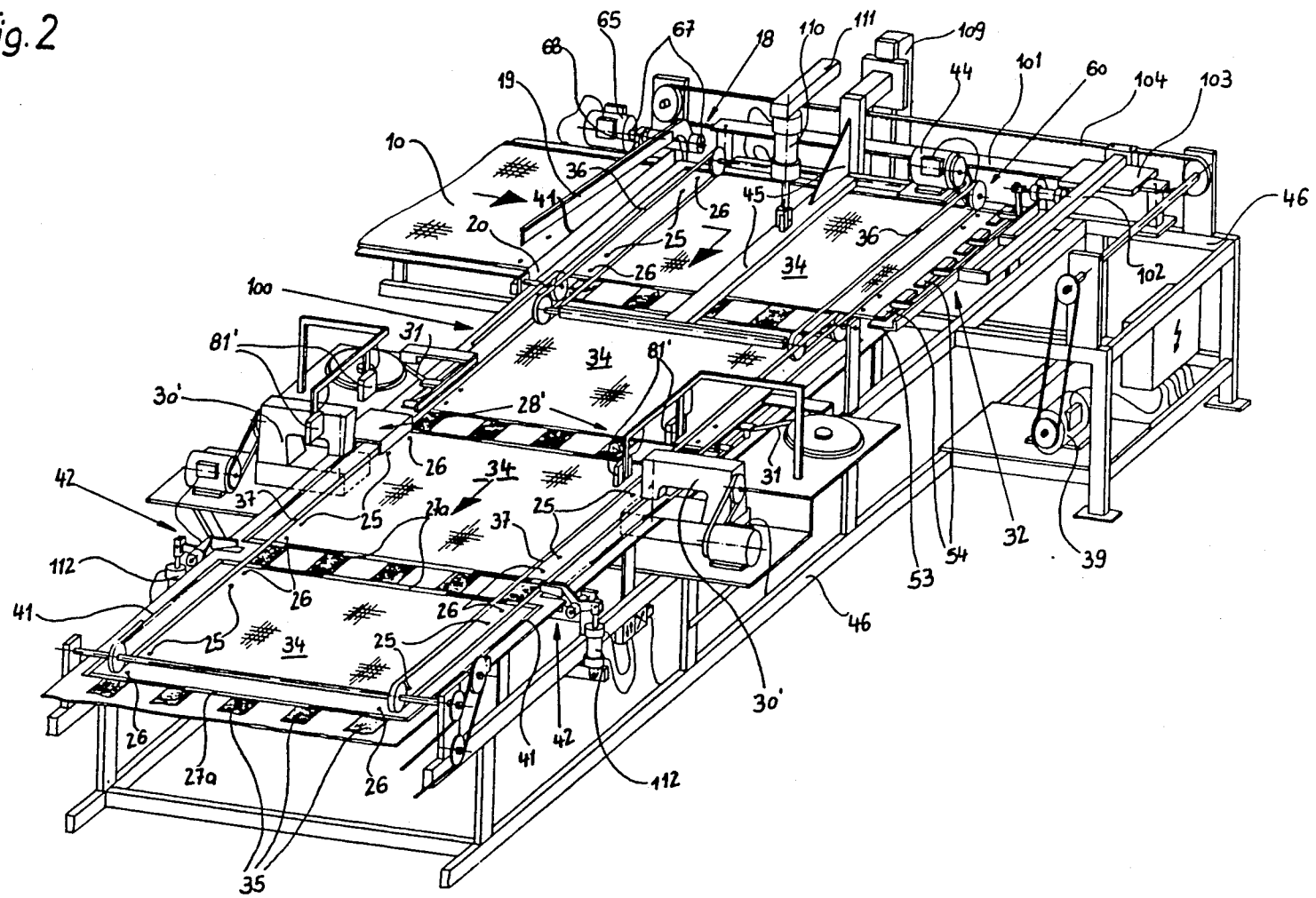

Electric motor 44 for top conveyor belt 36 is connected synchronously with motor 107 for conveyor belts 35 and 37. Top conveyor belts 36 are guided by rollers, which are supported by a frame 45, to which is also fastened drive motor 44. Frame 45 is assembled and can move up and down on a column 109 attached to machine frame 46, and can be moved vertically by operating cylinder 110. Operating cylinder 110 is then activated in order to raise frame 45, when clamp 32 of FIG. 2 is moved to the left in contact with cut edge 41 of cloth strip 10 and, following pick-up of said edge, when clamp 32 is moved again to the right as in FIG. 2 into its original position. During this work phase of clamp 32, then, operating cylinder 110 raises frame 45 and therewith top conveyor belt 36 sufficiently that clamp 32 can be moved back under conveyor belt 36 against cutting device 18 and back. Then when cloth strip 10 is drawn over bottom conveyor belt 35 and clamp 32 has reached its starting position shown in FIG. 2, operating cylinder 110 lowers top conveyor belt 36 against cloth strip 10, whereupon this strip is then fixed, and is cut by blade 19. Clamp 32 is opened and the separated piece of cloth 34 is then carried by the now connected motors 44 and 107, by conveyor belts 35, 36 and 37 in the direction of the discharge end (FIG. 3) of the second conveyor device.

When the relevant separated piece of cloth 34 has been moved out of the path of movement of clamp 32, the drive of second conveyor device 100 is reconnected. Clamp 32 is now moved again against cutting device 18, where it picks up cut edge 41 of cloth strip 10 which is still clamped tightly by retaining strip 21. After release of cloth strip 10 by retaining strip 21, clamp 32 is moved back into its starting position shown in FIG. 2, while at the same time drive rollers 13 and 16 are activated, in order to pull down another length of cloth stip 10 of the length to be cut, from supply 12. When this length has been reached, motors 24, 27 and 39 are again disconnected. After the next separation of another piece of cloth 34 by cutting blade 19 and discharge of this piece of cloth 34 in the direction of the arrow of FIG. 2, to the left, by second conveyor device 100, clamp 32 is moved again against cutting device 18 and the process is repeated.

When the individual pieces of cloth 34 are moved by second conveyor device 100 of FIG. 2 in the direction of the arrow, intermittently to the left toward the discharge end of the device (FIG. 3), two more stretched elastic bands 31' of predetermined lengths are sewn in at both of its cut or transverse edges 41 in turn. This work process corresponds to the process already described and the sewing in of stretched elastic bands 31' and feed devices 28' and sewing machines 30 for this purpose correspond in their arrangement and in the method of operation to those already described in connection with FIGS. 1 and 3. Corresponding parts are therefore provided with the same reference numbers, which however are raised by additional apostrophes. Sensors 81' correspond to sensors 81, but scan marking points 25 and 26 which are present in two pairs opposite cut edges 41.

Figure 3:
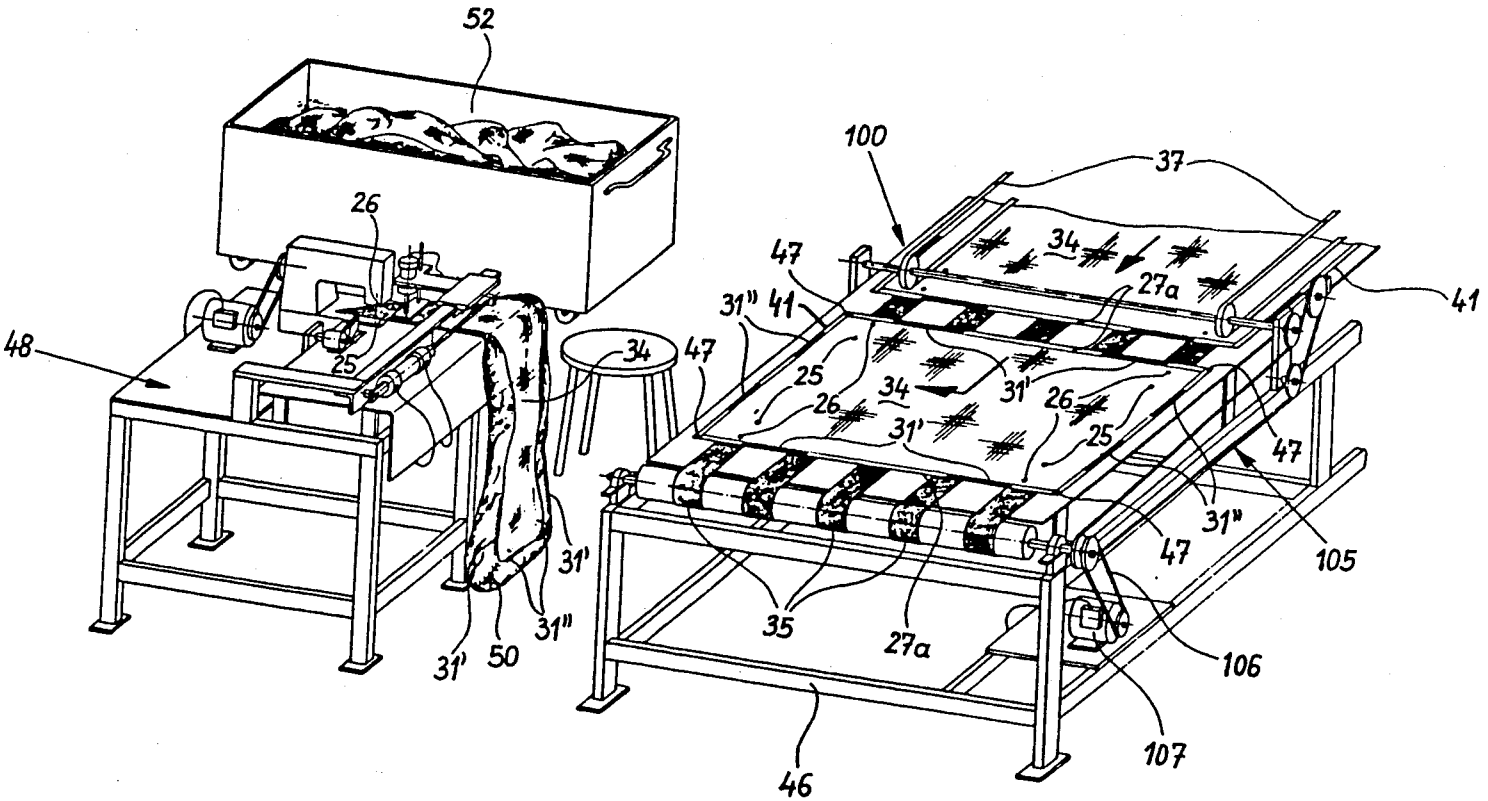
FIG. 3 is a perspective view of the delivery end of the device of FIGS. 1 and 2, together with a manual sewing site, at which the pieces of cloth which are being delivered from the device are further processed into completed fitted elastic bedsheets.

Two thread cutting devices 42 are shown in FIG. 2, which cut through the threads coming out of sewing machines 30', so that pieces of cloth 34 are again isolated from each other, when they near the discharge end of second conveyor device 100 (FIG. 3). Operating cylinder 112 of these thread cutting devices 42 could be controlled by not shown scanning devices which scan the lengthwise edges 27*a* of individual pieces of cloth 34.

Stretched elastic bands 31' and 31" of predetermined lengths are thus sewn in completely automatically by the described device on lengthwise edges 27*a* and transverse edges 41 of a piece of cloth 34 and in uniform spacing from each other, and also at the same spacing from each corner 47 of a piece of cloth 34 (FIG. 5). Elastic bands 31' and 31" which are sewn in the above manner, in stretched-out state, in slackened state then produce the wrinkling formation of folds on piece of cloth 34 indicated in FIG. 5.

Figure 6:
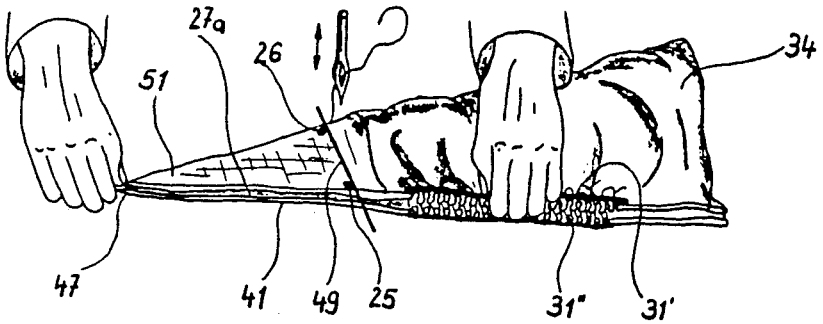
FIGS. 6 and 7 are perspective views of different steps in the processing of the partially fabricated fitted elastic bedsheet of FIG. 5.
Figure 7:
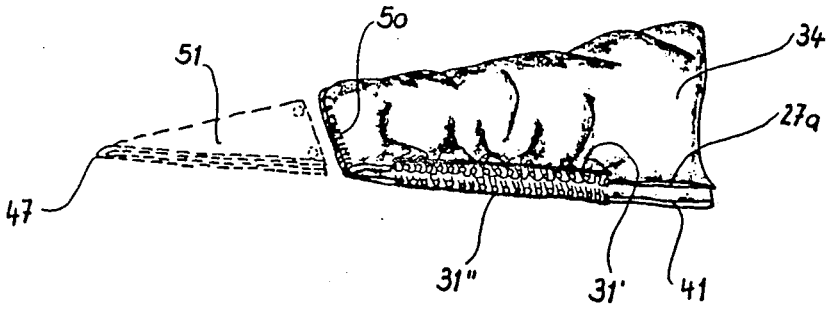

When a piece of cloth 34 has been brought by bottom conveyor belt 35 into the delivery position of second conveyor device 100 (FIG. 3), it is removed by a tailor or seamstress in the direction of the arrow and worked further at a manual sewing station 48. This occurs in such a manner that piece of cloth 34 is indicated at each corner 47, as in FIGS. 6 and 7, first as being diagonally folded, so that the cloth edges 27*a* and 41 adjacent to corner 47 run flush (FIG. 6). Then, along an imaginary line 49 connecting marking points 25 and 26, a connecting seam 50 is produced and the folded cloth section 51 is cut from piece of cloth 34 along this seam 50 with corner 47 to the side. When these work steps have been completed on all four corners 47 of piece of cloth 34, the fitted elastic bedsheet is completed and can be aligned for removal in a container 52.

Feed devices 28, 28' for elastic bands 31 can be controlled also so that a stretched elastic band is in turn prevented from passing through lengthwise edges 27*a* and/or transverse edges 41 of pieces of cloth 34, while it is still nonetheless spaced from corners 47 as described relative to the exemplary embodiment.

Furthermore, in a modification of the exemplary embodiment, a stamping apparatus can be provided in the area of the discharge end from conveyor device 100, which separates corners 47 from each piece of cloth 34 by rectangular punching, so that at the sewing station the adjacent pairs of cut edges must only be laid out flush to each other and sewn together. The corners are punched out by punching of cloth pieces 34 in flat state. A still more extensive machine fabrication of the fitted elastic bedsheets is thus attained.

What is claimed is:

1. Device for the manufacture of partially fabricated fitted elastic bedsheets or similar seat covers, in which rectangular pieces of cloth are cut from a strip of cloth by means of a cutting device, characterized by:

a. a first conveyor device (60) for the strip of cloth (10), which intermittently draws lengths of the strip from a supply (12) corresponding to the segment lengths of the partially fabricated fitted elastic bedsheets (34);

b. a first cutting device (18) being positioned in the area of the end of the first conveyor device (60);

c. a second conveyor device (100) for the pieces of cloth (34) which are cut from the strip of cloth (10) by the first cutting device (18), arranged at a right angle to the conveyor device (60) for the strip of cloth (10);

d. feed devices (28, 28') for stretched elastic bands (31) or the like along both lengthwise edges (27) of the strip of cloth (10) and along the two cut edges (41) of the pieces of cloth (34), which include means to guide the elastic bands (31) in stretched-out state parallel to both lengthwise edges (27) of the strip of cloth (10) or parallel to both cut edges (41) of the piece of cloth (34);

e. sewing machines (30, 30') positioned directly after the feed devices (28, 28') for the elastic bands (31) in the direction of conveyance of the strip of cloth (10) or pieces of cloth (34) for sewing of the stretched elastic bands (31) in stretched-out state parallel to the edges of the strip of cloth (10) or the pieces of cloth (34); and f. second cutting devices (42) on each side of the second conveyor device (100) for cutting through the materials which are connecting the separate pieces of cloth (34) behind the sewing machines (30').

2. Device as in claim 1, characterized in that each feed device (28, 28') for a stretched elastic band (31) has at least one pressure roller (89) holding the elastic band (31) against the strip of cloth (10) or piece of cloth (34), in order to feed the elastic band (31) by friction contact dependent upon the movement of the strip of cloth (10) or pieces of cloth (34).

3. Device as in claim 1, characterized in that each feed device (28, 28') for a stretched elastic band (31) has a brake element (87) which can press the stretched elastic band (31) against a stationary base (88).

4. Device as in claim 2, characterized in that the pressure rollers (89) are mounted pivotably and each feed device (28, 28') for an elastic band (31) includes a cutting blade (93) for the strip, which is inserted series-connected in the direction of movement of the strip of cloth (10) or pieces of cloth (34) after the pressure rollers (89), and that at least one more pressure roller (96) for the stretched elastic band (31) is inserted after each cutting blade (93).

5. Device as in claim 1, characterized in that a folding element (97) for the lengthwise edges (27) of the strip of cloth (10) or the cut edges (41) of the pieces of cloth (34), which folds these edges (27, 41) around the stretched elastic bands (31), is inserted after the feed devices (28, 28') for the elastic bands (31) in the direction of movement of the strip of cloth (10) or pieces of cloth (34).

6. Device as in claim 1, characterized in that marking devices (24) which can be raised and lowered in order to apply markings (26) on the strip of cloth (10), are arranged before the feed devices (28) for the elastic bands (31) in the direction of movement of the strip of cloth (10), and that sensors (81, 81') are provided for scanning these markings (26), which control the feed devices (28, 28') for the stretched elastic bands (31), and the sewing machines (30, 30'), and the drive (65) of the cutting device (18) for the strip of cloth (10).

7. Device as in claim 1, characterized in that a length measuring apparatus (74) is provided over the strip of cloth (10), with a measuring wheel (22) which can be driven by the strip of cloth (10), which controls at least the drive motors (14, 17, 39) of the first conveyor device (60).

8. Device as in claim 1, characterized in that the first conveyor device (60) for the cloth strip (10) has a clamp (32) which can be moved back and forth in its lengthwise direction, inserted after the cutting device (18) in the direction of movement of cloth strip (10), to pick up the cut edge (41) of the strip of cloth (10), that the path of movement of the clamp (32) intersects the beginning area of the second conveyor device (100) and that the second conveyor device (100) has bottom and top conveyor belts (35, 36 and 37) and a part (36) of the top conveyor belt can be raised and lowered.

9. Device as in claim 8, characterized in that the top conveyor belts (36) at the beginning of the second conveyor device (10) are supported by a frame (45) which can be raised and lowered by a lift device (109 to 111).

10. Device as in claim 1, characterized in that the second conveyor device (100) can also be driven intermittently, so that it can be in rest position when the first conveyor device (60) is activated.

* * * * *

UNITED STATES PATENT AND TRADEMARK OFFICE

CERTIFICATE OF CORRECTION

PATENT NO. : 4,748,922

DATED : June 7, 1988

INVENTOR(S) : Bierbaum et al.

It is certified that error appears in the above-identified patent and that said Letters Patent are hereby corrected as shown below: On the Title Page:

On the face of the patent, correct the first word in the name of the Assignee from "Texas" to --Texpa--.

Signed and Sealed this

Eleventh Day of October, 1988

*Attest:*

DONALD J. QUIGG

*Attesting Officer*

*Commissioner of Patents and Trademarks*